US005210385A

United States Patent [19]

Morel et al.

[11] Patent Number: 5,210,385

[45] Date of Patent: May 11, 1993

[54] LOW VOLTAGE CIRCUIT BREAKER WITH MULTIPLE CONTACTS FOR HIGH CURRENTS

[75] Inventors: Robert Morel, Eybens; Marc Rival, Virieu; Hubert Garcia, St. Geoires; Pierre Miguet, Grenoble, all of France

[73] Assignee: Merlin Gerin, France

[21] Appl. No.: 777,124

[22] Filed: Oct. 16, 1991

[51] Int. Cl.[5] ..... H01H 33/12; H01H 33/20; H01H 9/46

[52] U.S. Cl. ..... 200/146 R; 200/144 R; 200/147 R

[58] Field of Search ..... 200/144 R, 144 C, 146 R, 200/146 A, 146 AA, 147 R, 147 A, 147 B; 335/201, 8-16

[56] References Cited

U.S. PATENT DOCUMENTS 3,585,329 6/1971 Walker et al. ..... 200/146 R
4,295,022 10/1981 Robins ..... 200/147 R X
4,737,606 4/1988 Winter ..... 200/144 R
4,764,650 8/1988 Bur et al. ..... 200/144 C X
4,968,859 11/1990 Davies et al. ..... 200/146 R
4,996,507 2/1991 McKee et al. ..... 200/147 R X

*Primary Examiner*—J. R. Scott
*Attorney, Agent, or Firm*—Parkhurst, Wendel & Rossi

[57] ABSTRACT

To improve the electrical withstand of a low voltage circuit breaker for high currents having multiple contacts of the same length and a stationary arc guiding horn having an intermediate edge extending over a short distance in the direction of movement of the front extensions of the contact fingers, a stationary arcing contact is arranged between the edge of the arc guiding horn and the stationary main contact. The stationary main contact is designed to cooperate with a movable arcing contact of at least one contact finger. At the beginning of the opening travel, closing of the arcing contacts takes place before the main contacts separate. The stationary arcing contact is located in the immediate vicinity of the edge.

4 Claims, 4 Drawing Sheets

LOW VOLTAGE CIRCUIT BREAKER WITH MULTIPLE CONTACTS FOR HIGH CURRENTS

BACKGROUND OF THE INVENTION

The invention relates to a multipole low voltage circuit breaker high currents, housed in a molded insulating case, each pole comprising:

a plurality of movable contact fingers of the same length extending parallel to the fingers slightly apart from one another, and being driven in unison between a closed position and an open position by a mechanism.

a stationary main contact cooperating in the closed position with a movable main contact of each contact finger, a pair of connection pads in electrical connection with the stationary main contact and the contact fingers, an arc extinguishing chamber having a stack of deionizing metal plates with a pair of conducting horns for guiding the migration of the arc, one of the stationary horns being in electrical connection with the stationary main contact and having an intermediate edge extending past the stationary main contact along the direction of movement of the front extensions of the contact fingers, thereby limiting lengthening of the arc during the initial separation phase.

A state-of-the-art circuit breaker of the kind mentioned is described in U.S. Pat. No. 4,764,650, and enables very intensity short-circuit currents to be interrupted. The arc is prevented from returning to the arc formation zone by the presence of the edge on the stationary arc guiding horn. The separable contacts act as both main contacts and arcing contacts. Tests have revealed that the arc may stagnate, causing premature erosion of the contacts depending on the type of fault, notably in the presence of direct currents.

In the circuit breaker described in U.S. Pat. No. 4,295,022, the center contact finger alone supports the movable arcing contact, and is of greater length than the juxtaposed contact fingers supporting the movable main contacts. The arcing contacts are always closed in the closed position of the circuit breaker. Fitting two types of contact fingers complicates the manufacture of each circuit breaker pole.

The object of the present invention is to improve the electrical withstand of a low voltage circuit breaker for high currents.

SUMMARY OF THE INVENTION

The circuit breaker according to the invention is characterized in that in the a stationary arcing contact is disposed between an arcing horn and a stationary main contact. The stationary arcing contact is designed to cooperate with a movable arcing contact of at least one contact finger, and closing of the arcing contacts takes place after the beginning of the opening travel of the contact fingers before the main contacts separate, The stationary arcing contact is positioned closer to an intermediate edge of the arcing horn than to the stationary main contact.

All the contact fingers have an identical structure and bear movable main contacts. Some of these fingers become temporary arcing contacts at the beginning of the opening phase.

The presence of the arcing contacts prevents erosion of the main contacts, whereas the closeness of the arc to the edge speeds up migration of the arc along the guide horn, and reduces erosion of the arcing contacts. This results in improved electrical withstand of the circuit breaker, regardless of the type of fault and of the nature of the current.

To prevent thermal action of the arc on the side walls of the insulating case, the stationary arcing contact is arranged to center the arc with respect to the mid-plane of the pole. (i.e., keep the arc away from the side walls) The stationary main contact and stationary arcing contact are formed by two small parallel plates extending transversely with respect to the contact fingers, the plate of the stationary arcing contact being shorter than that of the stationary main contact.

The contact fingers are pivotally mounted on a first transverse spindle inside a support cage made of insulating material. The cage can pivot between the open and closed positions around a second articulation spindle due to the action of a mechanism. The assembly is arranged to bring about reverse rotation movements of the cage and contact fingers when closing of the arcing contacts takes place.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
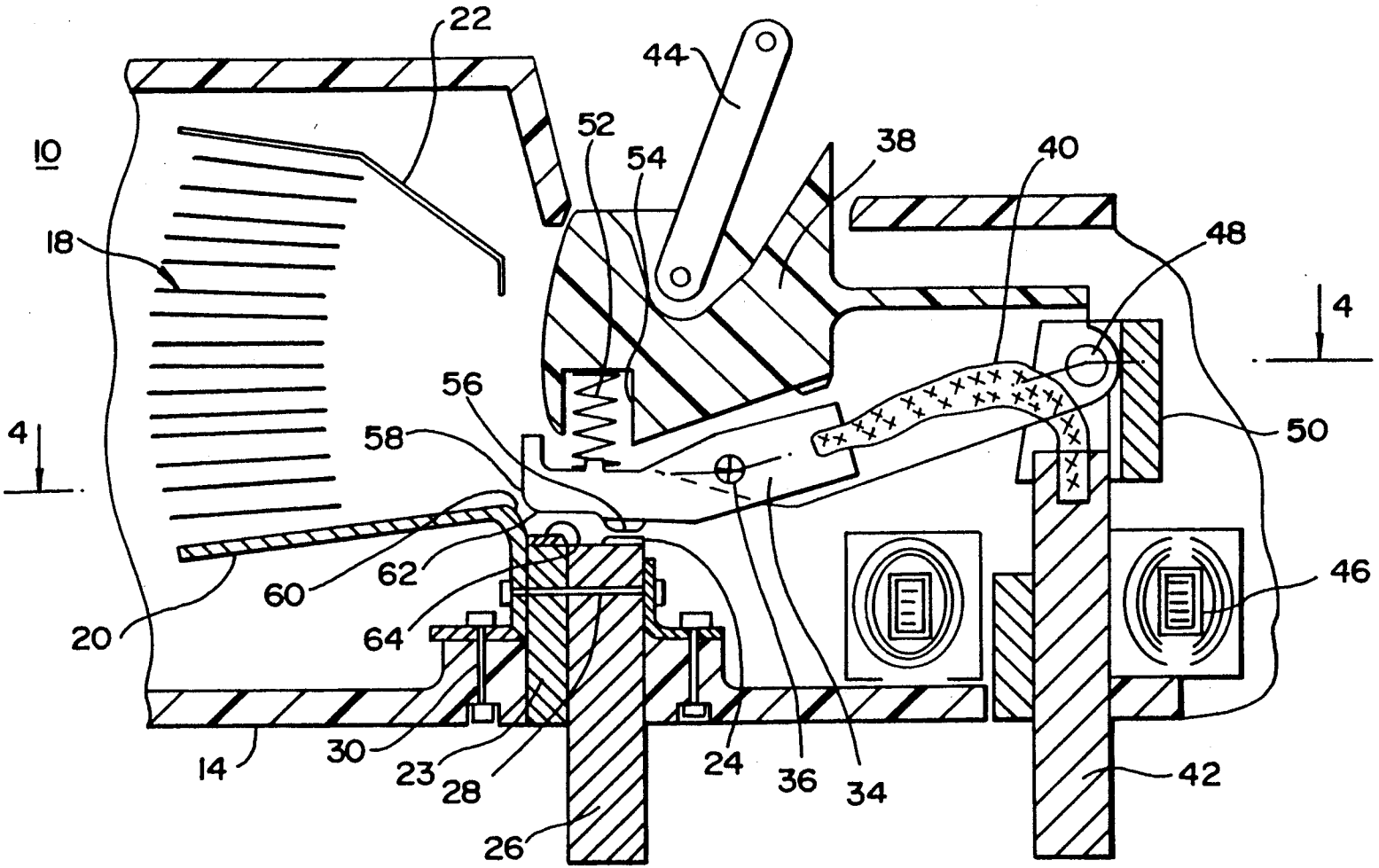
FIG. 1 is a sectional view of a pole of the circuit breaker, represented in the closed position.
Figure 2:
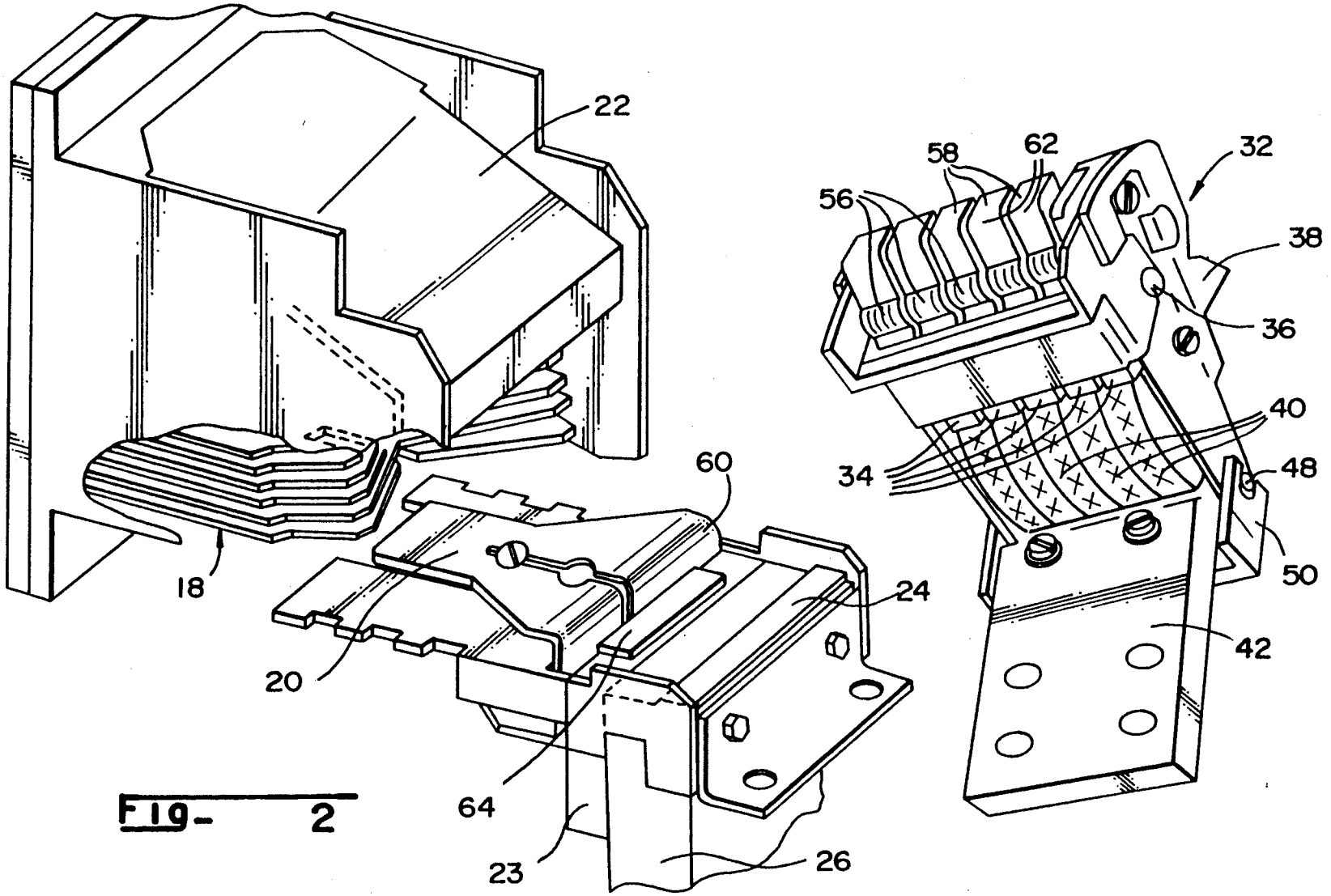
FIG. 2 shows an exploded perspective view of the circuit breaker in FIG. 1.
Figure 3:
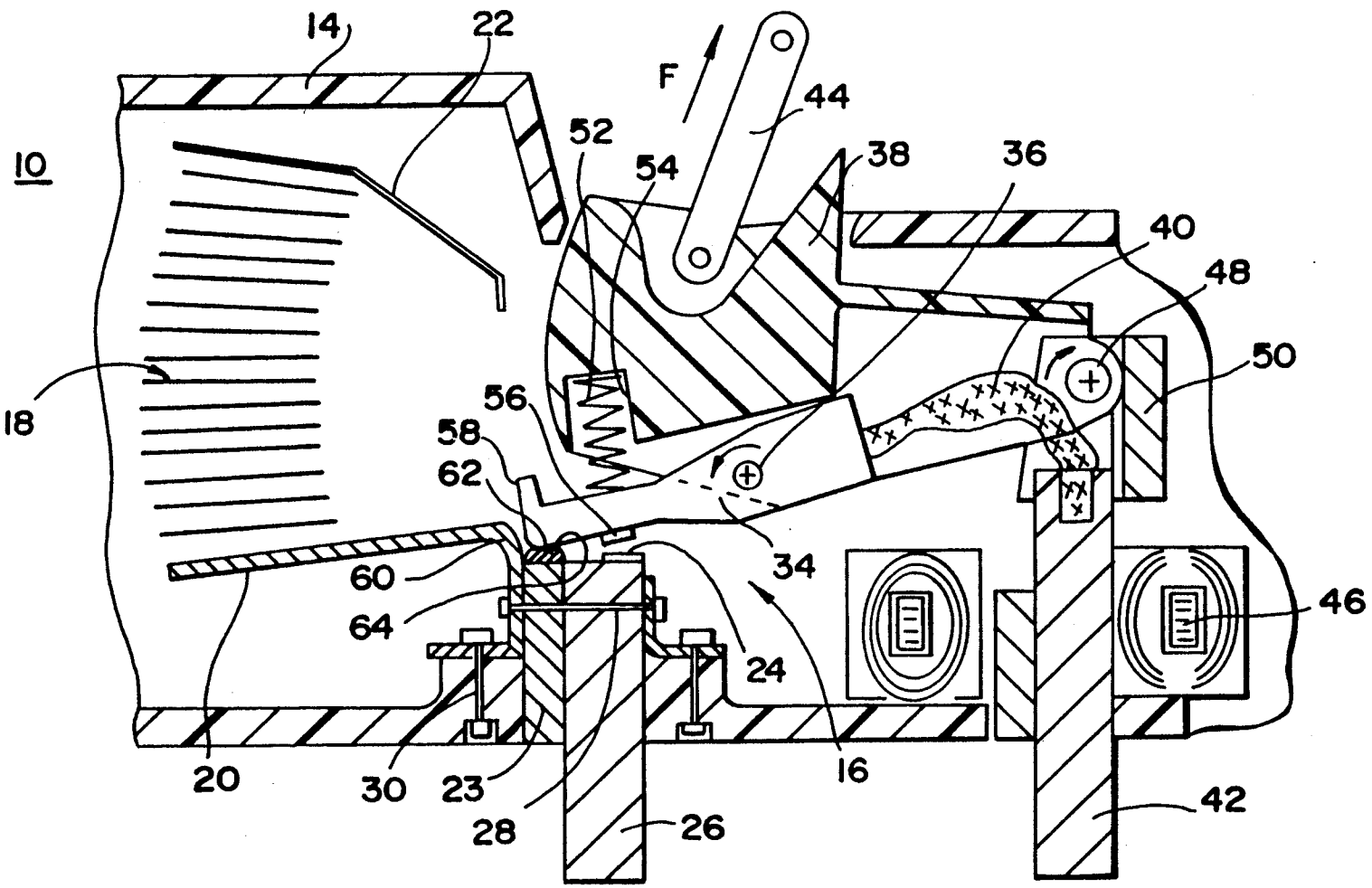
FIG. 3 is an identical view to that of FIG. 1, in an intermediate position at the beginning of opening travel of the pole.
Figure 4:
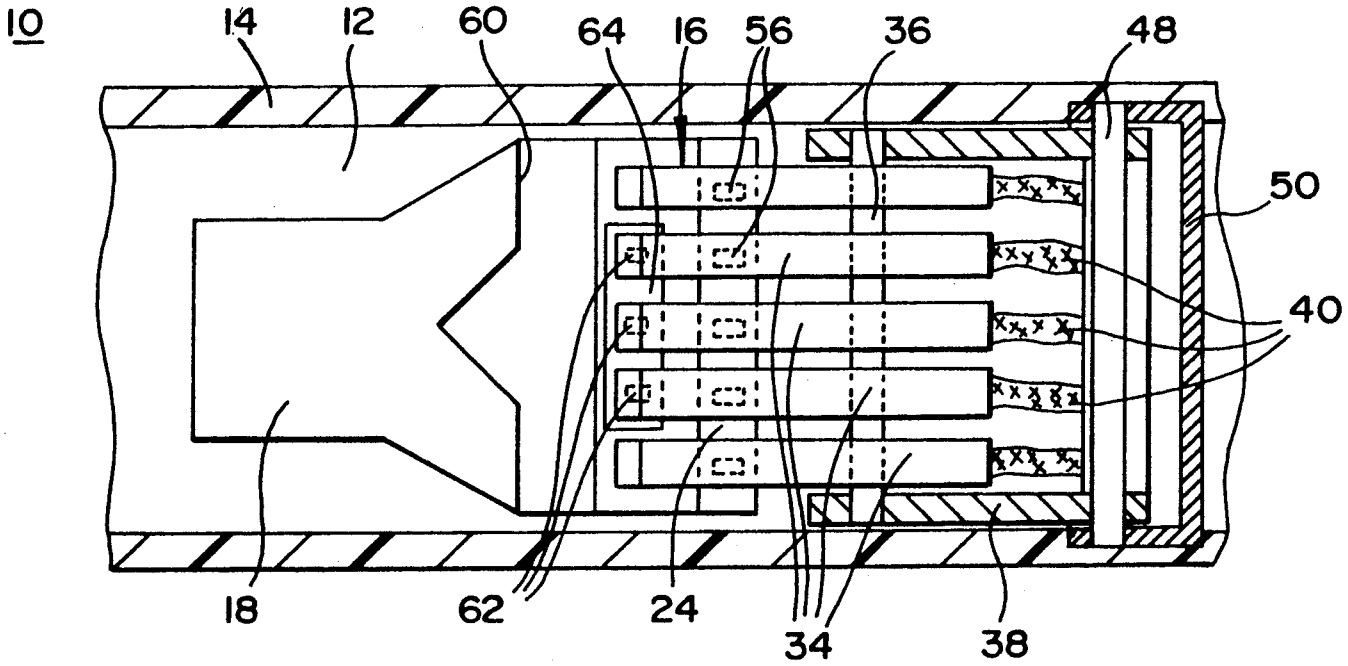
FIG. 4 represents a cross-sectional view along the line 4—4 in FIG. 1.

In FIGS. 1 to 4, a pole 10 of a non-limiting low-voltage circuit breaker for high currents, notably greater than 1000 A, is housed in a compartment 12 of a molded insulating case 14, housing a separable contact device 16, and an arc extinguishing chamber 18. The structure of a pole of this kind is described in detail in the abovementioned U.S. Pat. No. 4,764,650.

The arc extinguishing chamber 18 is equipped with a stack of metal plates, with a pair of lower 20 and upper 22 conducting arc guiding horns located on either side thereof. The stationary arcing horn 20 is made of steel and extends between a conducting art 23 adjoined to the connection pad 26 and the chamber 18 defining one of the end plates thereof.

The separable contact device 16 comprises a stationary main contact 24 supported by first connection pad 26 which passes through the base of the insulating case 14. The lower arcing horn 20 is secured to the conducting part 23 of the connection pad 26 and to the base of the 14 by fixing means 28, 30. The movable contact assembly 32 is provided with a plurality of parallel contact fingers 34 pivotally mounted on a first transverse spindle 36 inside a support cage 38 made of insulating material. All the contact fingers 34 have the same length. The stationary main contact 24 extends transversely with respect to contact fingers 34 in a direction parallel to the first spindle 36.

The heel of each contact finger 34 is connected by a flexible conductor, notably a braided strip 40, to a second connection pad 42 which passes through the base of the case 14, and which extends parallel to the first pad 26.

The cage 38 is coupled to the switching bar of the mechanism (not shown) by a transmission rod 44. The internal portion of the second pad 42 is surrounded by a current sensor 46 electrically connected to the mechanism trip device. The end of the cage 38 located above the second pad 42 is equipped with a second spindle 48 housed in a fixed bearing 50, to allow the cage 38 to pivot following rotation of the bar between the open and closed positions of the pole 10. A contact pressure spring device 52 is positioned in a notch 54 of the cage 38, and urges the contact fingers 34 to pivot counterclockwise around the first spindle 36.

Each contact finger 34 is provided with a movable main contact 56, cooperating in the closed position with the stationary main contact 24. The first transverse spindle 36 is located between the movable main contacts 56 and the braided strips 40.

Opposite from the heel, each contact finger 34 comprises a front extension 58 protruding out from the cage 38, and capable of moving along an edge 60 or boss of the lower arcing horn 20.

According to the invention, the front extension 58 of each contact finger 34 is shaped as an arcing horn having a movable arcing contact 62 designed to cooperate with a stationary arcing contact 64 located near the edge 60 of the arcing horn 20. The stationary arcing contact 64 is secured to the intermediate part 23 and is in electrical connection with the horn 20, and the connection pad 26. Stationary arcing contact 64 is arranged between the edge 60 and the stationary main contact 24.

The width of the stationary arcing contact 64 is smaller than that of the stationary main contact plate 24. This results in the movable arcing contacts 62 of the end fingers 34 not being in contact with the stationary arcing contact 64 (see FIG. 4) when the pole opens.

Operation of the pole 10 is as follows:

In the closed position (FIGS. 1 and 4), each movable main contact 56 is in contact with the stationary main contact 24. The contact pressure is ensured by the spring device 52. A predetermined gap separates the arcing contacts 62, 64 and the rated current flows only in the closed contacts 24, 56 of the main circuit.

When the circuit breaker opens, the rod 44 acts on the cage 38 in the direction of the arrow F (FIG. 3), causing the cage 38 to pivot clockwise around the second spindle 48. Concurrently, the contact fingers 34 pivot in the reverse direction (counter clockwise) around the first spindle 36. Fleeting closing of the arcing contacts 62, 64 takes place prior to separation of the main contacts 24, 56, which takes place without an arc. In this intermediate position, the whole current then flows in the arcing contacts 62, 64 due to this temporary contact zone located very close to the edge 60 of the horn 20.

Continued pivoting of the cage 38 then causes the arcing contacts 62, 64 to separate after the rear of the contact fingers 34 has come up against the cage 38. This separation results in formation of an arc, which migrates very quickly to the edge 60 and is driven to the chamber 18 where it deionizes in a conventional manner. During this initial separation phase of the arcing contacts 62, 64, lengthening of the arc is limited.

The presence of the arcing contacts 62, 64 prevents erosion of the main contacts 24, 56. The closeness of the arc to the edge 60 speeds up migration of the arc along the guide horn 20, and then improves transmission of the arc to the chamber 18 for high-speed extinction. Arranging the edge 60 near the arc formation zone and along the direction of movement of the contact fingers 34 reduces erosion of the arcing contacts 62, 64, and contributes to reducing the time required for the arc to travel to the chamber 18.

The reduced length of the stationary arcing contact 64 with respect to stationary main contact 24 enables centering of the arc with respect to the mid-plane of the chamber 18, thus preventing wear of the side walls of the insulating case 14 due to the thermal action of the arc. This results in a notable improvement of the electrical withstand of the non-limiting circuit breaker, which is able to interrupt any type of current, notably alternating short-circuit currents, or direct currents of low intensities.

According to an alternative embodiment, the stationary arcing contact 64 could be fixed directly to the arcing horn 10.

We claim:

1. A multipole low voltage circuit breaker for high currents, said circuit breaker being housed in an insulating case, each pole comprising:

a plurality of movable contact fingers, each of said contact fingers having the same length, said contact fingers extending parallel to and spaced apart from each other, each of said contact fingers comprising a movable main contact and a front extension extending from said movable main contact, at least one of said contact fingers comprising a movable arcing contact disposed along said front extension;

a stationary main contact electrically connected to a first connection pad, said stationary main contact positioned to be electrically connected with said movable main contact of each of said contact fingers;

an arcing extinguishing chamber comprising a plurality of stacked metal plates for deionizing an arc, said stacked metal plates being disposed between upper and lower stationary horns, said upper and lower stationary horns being made of a conducting material, said lower stationary horn being electrically connected to said stationary main contact;

a stationary arcing contact fixed between said lower stationary arcing horn and said stationary main contact, said stationary arcing contact being electrically connected to said lower stationary horn and said first connection pad, wherein said stationary arcing contact is fixed in position with respect to said movable contact fingers;

urging means to drive said contact fingers between open and closed positions, wherein said movable and stationary main contacts are electrically connected while said movable and stationary arcing contacts are spaced apart from each other in said closed position, and wherein said movable main contacts and said movable arcing contact are spaced apart from said stationary main contact and said stationary arcing contact, respectively, in said open position;

wherein said lower stationary horn comprises a protrusion which extends past said stationary arcing contact in a direction of movement of said contact fingers towards said open position; and wherein said movable and stationary arcing contacts are electrically connected with each other at an intermediate position between said open and closed positions.

2. The device of claim 1, wherein said lower stationary horn is made of steel, and the stationary main contact and stationary arcing contact each comprise a plate which extends transversely with respect to the contact fingers, the plate of said stationary arcing contact being shorter in length than the plate of said stationary main contact such that an arc generated between said movable and stationary arcing contacts is spaced apart from side walls of said insulating case housing said circuit breaker.

3. The device of claim 2, wherein the plate of said stationary arcing contact is supported by a conducting part inserted between said lower stationary horn and said first connection pad.

4. The device of claim 1, further comprising:

a support cage of insulating material, said support cage supporting said contact fingers along a first transverse spindle such that said contact fingers are pivotally mounted on said first transverse spindle, said urging means being connected to said support cage and comprising a transmission rod; and a second transverse spindle on which said support cage is mounted, said urging means driving said cage to rotate about said second transverse spindle, whereby said contact fingers rotate about said first transverse spindle in an opposite direction with respect to rotation of said support cage.

* * * * *